US007055196B2

(12) United States Patent
Littlehorn

(10) Patent No.: US 7,055,196 B2
(45) Date of Patent: Jun. 6, 2006

(54) PREGNANCY SUPPORT PILLOW

(75) Inventor: Sheila Littlehorn, Littleton, CO (US)

(73) Assignee: The Boppy Company, Golden, CO (US)

( * ) Notice: Subject to any disclaimer, the term of this patent is extended or adjusted under 35 U.S.C. 154(b) by 0 days.

(21) Appl. No.: 10/927,404

(22) Filed: Aug. 25, 2004

(65) Prior Publication Data

US 2006/0042012 A1 Mar. 2, 2006

(51) Int. Cl.
*A47C 16/00* (2006.01)

(52) U.S. Cl. ..... 5/631; 5/632; 5/652; 5/930

(58) Field of Classification Search ..... 5/630–632, 5/636, 652, 655.3–655.5
See application file for complete search history.

(56) References Cited

U.S. PATENT DOCUMENTS 2,328,871 A * 9/1943 Woehler ..... 5/636
4,624,021 A * 11/1986 Hofstetter ..... 5/632
4,731,890 A * 3/1988 Roberts ..... 5/655
5,978,990 A * 11/1999 Akey ..... 5/632
5,987,674 A * 11/1999 Schaffner et al. ..... 5/632
6,055,687 A 5/2000 Matthews
6,279,185 B1 * 8/2001 Matthews ..... 5/655
6,434,770 B1 8/2002 Matthews Brown
6,463,608 B1 10/2002 Moe
6,484,337 B1 11/2002 Moe et al.
6,499,164 B1 * 12/2002 Leach ..... 5/632
6,532,612 B1 3/2003 Matthews Brown
6,640,977 B1 11/2003 Matthews Brown et al.
6,671,908 B1 1/2004 Brown et al.
6,685,024 B1 2/2004 Matthews
6,751,817 B1 * 6/2004 Leach ..... 5/632

OTHER PUBLICATIONS

U.S. Appl. No. 10/612,267, filed Jul. 1, 2003, Matthews Brown.

* cited by examiner

*Primary Examiner*—Michael Trettel
(74) *Attorney, Agent, or Firm*—Townsend and Townsend and Crew LLP

(57) ABSTRACT

In one embodiment, a pillow comprises a curved pillow body having a top region and a bottom region. The top region is larger in size than the bottom region. Also, the bottom region is adapted to be placed between a user's lets while the user is lying on her side while the top region conforms to the user's stomach and chest.

24 Claims, 5 Drawing Sheets

PREGNANCY SUPPORT PILLOW

BACKGROUND OF THE INVENTION

This invention relates generally to the field of pillows, and in particular to support pillows. In one specific application, the invention relates to pillows that may be used by pregnant women, among others.

Pillows are used in a variety of applications. For example, pillows are used almost universally when sleeping to support the head. Pillows may also be used to support other tings as well. One example of such a pillow is the Boppy® support pillow, commercially available from The Boppy Company. Examples of such pillows are also described in U.S. Pat. Nos. 5,261,134 and 5,661,861, the complete disclosures of which are herein incorporated by reference. Such pillows may be used to support infants, assist with breast feeding and the like.

One use of pillows that has generally not been appropriately addressed is for pregnant women, for those who prefer sleeping on their side, for those suffering from back pain, and the like. While traditional pillows have undoubtedly been used with such individuals, a rectangular pillow is ill suited to meet the needs of such individuals. Hence, this invention is related to other types of support pillows dealing with these and other conditions.

BRIEF SUMMARY OF THE INVENTION

In one embodiment, the invention provides a pillow that comprises a curved pillow body having a top region and a bottom region. The top region is larger in size than the bottom region. This configuration permits the bottom region to be placed between a user's legs while the user is lying on her side while the top region conforms to her stomach and chest.

In one particular arrangement, the pillow body is kidney bean shaped in geometry and has an inner periphery and an outer periphery. In this way, the inner periphery is configured to conform to the user's stomach and chest while the bottom region is positioned between the user's legs. Hence, such a pillow comfortably nestles around the body, under the belly and between the knees for all-over support while sleeping or resting. Further, the pillow helps to relieve back pain by aligning the user's hips, leg and back. Such a pillow may find particular use with pregnant women, with the pillow helping to support the woman's stomach. However, it will be appreciated that there may be other uses as well, such as for people suffering from obesity or those with back pain.

In one aspect, the top region and the bottom region generally meet at an apex of curvature of the pillow body. The distance defined by a line between an end of the top region and an end of the bottom region and the apex may be in the range from about 2 inches to about 10 inches. In another aspect, the distance between the end of the bottom region and the apex may be in the range from about 8 inches to about 16 inches. Also, the distance between the end of the top region and the apex may be in the range from about 20 inches to about 30 inches. In one particular arrangement, the pillow body has curved ends at the top region and the bottom region.

In a further aspect, the pillow body may have a width at the bottom region that is in the range from about 6 inches to about 10 inches, a width at the apex that is in the range from about 10 inches to about 18 inches, and a width at the top region that is in the range from about 14 inches to about 20 inches. Also, the pillow body may have a girth at the bottom region that is in the range from about 20 inches to about 28 inches, a girth at the apex that is in the range from about 30 inches to about 40 inches, and a girth at the top region that is in the range from about 36 inches to about 48 inches. Still further, the pillow body may have a height at the bottom region that is in the range from about 3 inches to about 7 inches, a height at the apex that is in the range from about 6 inches to about 10 inches, and a height at the top region that is in the range from about 6 inches to about 12 inches. Finally, the pillow body may have a length that is in the range from about 26 inches to about 38 inches.

In a further aspect, the pillow body may comprise a casing that encloses a fill material, such as polyester fibers, foam materials, beads, feathers or the like. Optionally, the pillow may be inflatable. Also, the casing may comprise a first piece of fabric, a second piece of fabric, and a third piece of fabric. In this way, the third piece of fabric may connect the first and second pieces, with the third piece defining the outer periphery while the first and second pieces define first and second faces of the pillow body.

The pillows of the invention may also be used with removable covers that fit over the pillow body. In this way, the cover may be removed for washing or to simply be replaced by another cover. In one embodiment, the cover may comprise a first piece of fabric, a second piece of fabric, and a third piece of fabric, with the third piece of fabric connecting the first and second pieces. This allows the third piece to define an outer periphery of the cover while the first and second pieces define first and second faces of the cover. The pillow body or the cover may optionally be provided with one or more handles.

Construction of the casing of the pillow body and/or the cover in this manner permits the pillow to retain its shape when it is placed against the user's body. Also, this configuration permits the pillow to be folded together along the inner periphery, such as for storage.

In one aspect, the cover also defines an opening through which the pillow body is insertable. Also, a fastener may optionally be provided to close the opening.

The invention also provides an exemplary method for supporting a user while the user is lying on her side. The method may utilize a pillow that comprises a curved pillow body having a top region and a bottom region, wherein the top region is larger in size than the bottom region. The bottom region is placed between a user's legs, and the top region is positioned against the user's stomach and chest so as to conform to the shape of the user's stomach and chest. To facilitate such an arrangement, the pillow body may be kidney bean shaped in geometry and have an inner periphery and an outer periphery. The inner periphery positioned against the user's stomach and chest while the bottom region is positioned between the user's legs.

In one particular use, the user is a pregnant woman, and the top region is positioned so as to support the user's stomach. Optionally, a cover may be inserted over the pillow prior to using the pillow.

DETAILED DESCRIPTION OF THE INVENTION

The invention provides various pillows that are both elongate and curved so that they will comfortably nestle around the user's body. In one embodiment, the pillow may be larger on one end so that it may provide additional support to the person's upper body. The narrower end may be held between the user's legs. Hence, such a pillow provides support under the belly and between the knees to permit most of the body to be supported while sleeping or resting. The shape of the pillow also helps relieve back pain by aligning the hips, legs and back.

While particularly useful with pregnant women, the pillow may be used in a variety of other applications. For instance, the pillow may be used with individuals who are overweight, those suffering form back pain, those needing additional support while sleeping, and the like.

Figure 1:
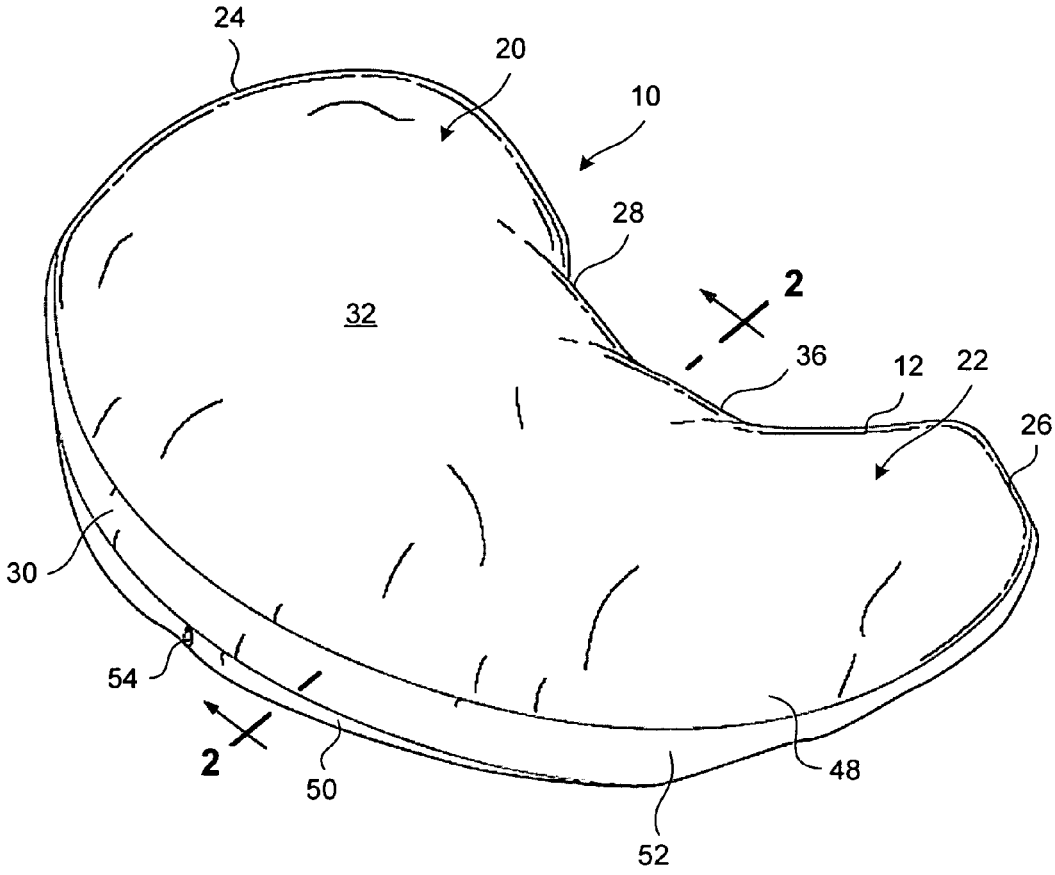
FIG. 1 illustrates one embodiment of a pillow according to the invention.
Figure 2:
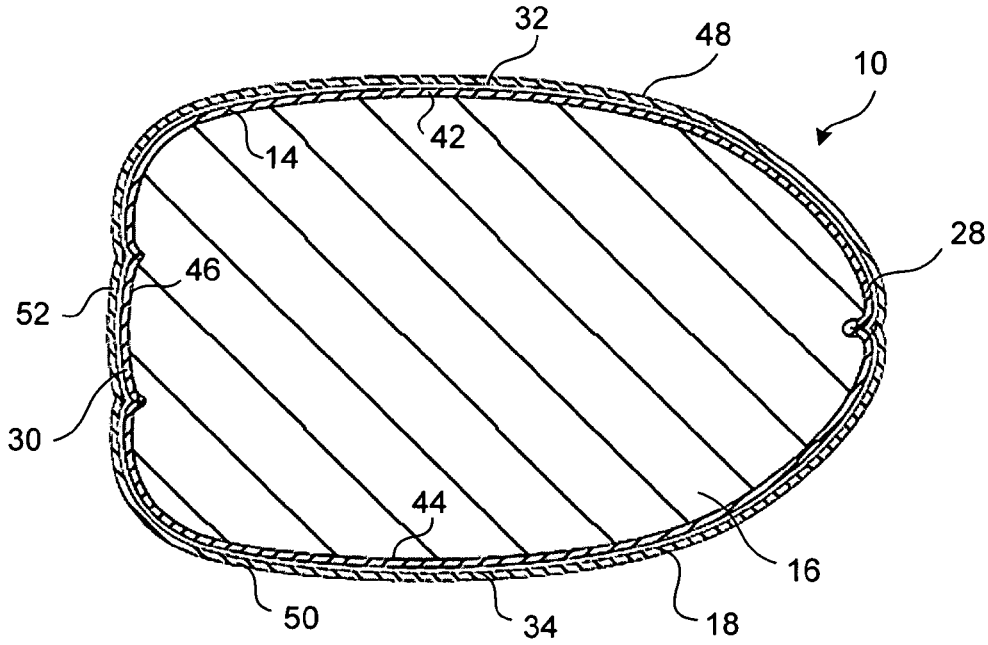
FIG. 2 is a cross sectional side view of the pillow of FIG. 1 taken along lines 2—2.

Referring now to FIGS. 1 and 2, one embodiment of a support pillow 10 will be described. Pillow 10 comprises a pillow body 12 (shown in phantom line in FIG. 1) that is constructed of a case 14 that encloses a fill material 16. Case 14 may be constructed from essentially any type of durable, flexible material, especially fabrics, such as those made from cotton, polyester, nylon and the like. Fill material 16 may be any type of material that provides an appropriate filling. When properly filled, pillow 10 should be firm enough so that it can generally maintain its shape, yet be soft enough so as to be comfortable, especially when held between the legs. Examples of fill materials that can be used include polyester fibers, other fiber materials, beads, seeds, foamed materials, and the like.

To construct pillow 10, any of the techniques described in U.S. Pat. Nos. 5,261,134; 5,661,861; 6,038,720; 6,055,687; 6,434,770; 6,352,612; 6,279,185; 6,412,128; 6,453,493; and 6,523,200, and U.S. application Ser. No. 10/046,377, filed Oct. 26, 2001; Ser. No. 09,884,742, filed Jun. 18, 2001; Ser. No. 09/679,139, filed Oct. 3, 2000; Ser. No. 09/802,097, filed Mar. 8, 2001; Ser. No. 10/426,067, filed Apr. 28, 2003; Ser. No. 10/612,266, filed Jul. 1, 2003; and Ser. No. 10/512,267, filed Jul. 1, 2003, the complete disclosures of which are herein incorporated by reference. Also, in some cases pillow 10 may be inflatable. For example, pillow body 12 may be constructed of an inflatable bladder.

Figure 3:
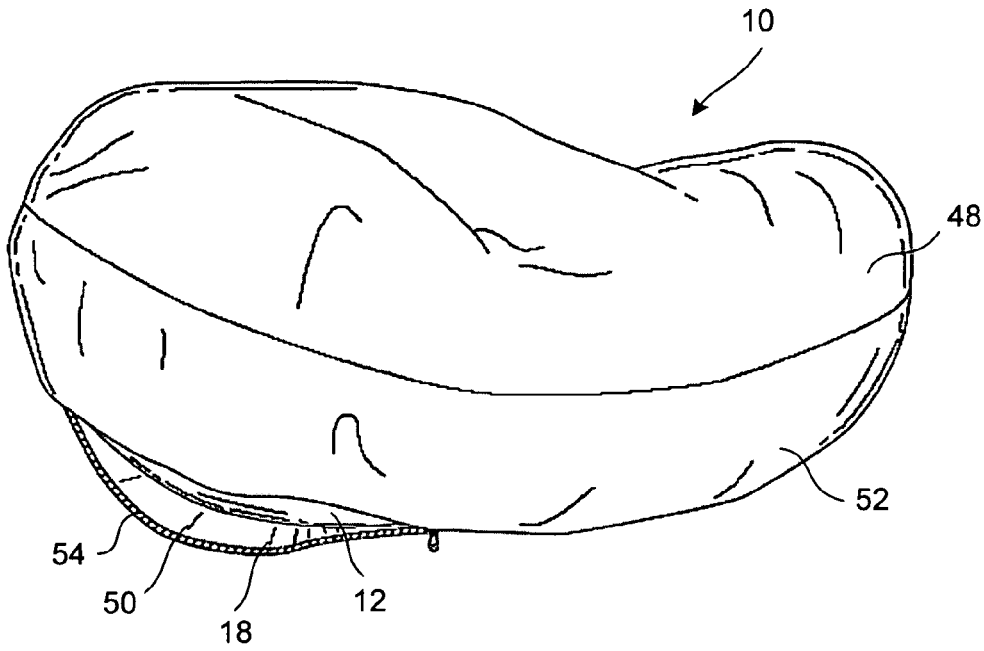
FIG. 3 illustrates the pillow of FIG. 1 with a slip covering being removed.

Optionally, a slipcover 18 may be placed over pillow body 12. Slip cover 18 may be constructed in a variety of ways and will be described in greater detail hereinafter with reference to FIG. 3.

Pillow body 12 may conveniently be described in terms of a top region 20 and a bottom region 22, even though the pillow may be used in any orientation. Top region 20 has an end 24 while bottom region 22 has an end 26. Also, pillow body 12 may conveniently be described as having a kidney bean shape with a curved inner periphery 28 and a curved outer periphery 30. Further, pillow body 12 has a pair of faces 32 and 24 extending between peripheries 28 and 30.

In one arrangement, pillow 10 is configured so that top region 20 is larger in size than bottom region 22. This arrangement permits bottom region 22 to comfortably fit between the user's legs, while the larger top region 20 is used to support the user's upper body (stomach and chest). However, in some cases, the two regions could be similar in size.

In the arrangement of FIG. 1, pillow 10 may have the following dimensions, it being appreciated that the invention is not limited to only such sizes. For instance, with a child or an extremely large person, the sizes could differ. To describe the dimensions, pillow 10 may be said to have an apex 36 between regions 20 and 22. If a line is drawn between ends 24 and 26, the perpendicular distance from that line to apex 36 (thereby defining the amount of curvature of inner periphery 28) is in the range from about 2 inches to about 10 inches, and more preferably from about 4 inches to about 8 inches. For a line drawn directly between bottom end 26 and apex 36, the distance is in the range from about 8 inches to about 16 inches, and more preferably from about 10 inches to about 14 inches. Between top end 24 and apex 36 the distance is in the range from about 20 inches to about 30 inches, and more preferably from about 24 inches to about 26 inches. The total length of pillow 10 from end 24 to end 26 may be in the range from about 26 inches to about 38 inches, and more preferably from about 30 inches to about 34 inches. Also, ends 24 and 26 may be curved or rounded in geometry. This size permits end 24 to reach the top of the user's chest while permitting end 26 to pass beyond the back of the user's legs.

The width of the bottom region 22 (across the face) is in the range from about 6 inches to about 10 inches, and more preferably from about 7 inches to about 9 inches. At the apex 36, the width is in the range from about 10 inches to about 18 inches, and more preferably from about 12 inches to about 16 inches. The widest part of top region 20 may be in the range from about 14 inches to about 20 inches, and more preferably from about 16 inches to about 18 inches.

When pillow body 12 is stuffed with a fill material, faces 32 and 34 may be generally curved, thereby providing suitable cushioning. The girth (or distance around) of pillow body 12 at bottom region 22 may be in the range from about 20 inches to about 28 inches at its widest point, and more preferably from about 22 inches to about 26 inches. The girth of pillow body 12 at apex 36 may be in the range from about 30 inches to about 40 inches, and more preferably from about 32 inches to about 38 inches. The girth of pillow body 12 at top region 20 may be in the range from bout 36 inches to about 48 inches at its widest part, and more preferably from about 40 inches to about 44 inches.

At its highest part, pillow body 12 may have a height at the bottom region 22 that is in the range from about 3 inches to about 7 inches, and more preferably from about 4 inches to about 6 inches. At apex 36, the height may be in the range from about 6 inches to about 10 inches, and more preferably from about 7 inches to about 9 inches. At top region 20, pillow body 12 may have a height that is in the range from about 6 inches to about 12 inches and more preferably from about 8 inches to about 10 inches.

Figure 4:
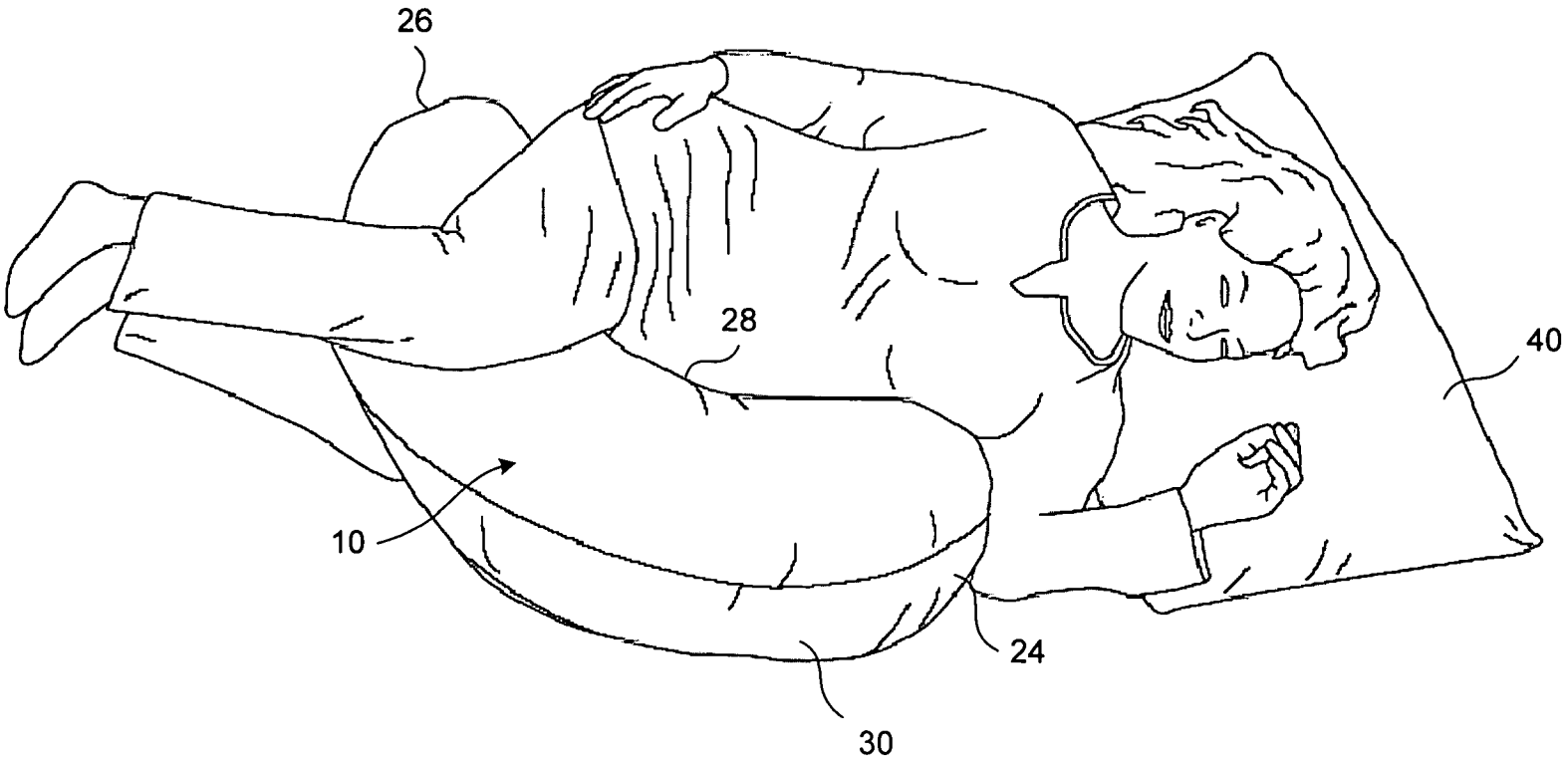
FIG. 4 illustrates one use of the pillow of FIG. 1.

As shown in FIG. 4, configuring the pillow as described about permits pillow 10 to conform to a user's body when the user in lying on her side. However, it will be appreciated that users may use pillow 10 in other ways, such as, for example, underneath the person's head, behind a person's back while sitting, on a person's lap, again a person' back when the person is lying on her side, and the like.

When lying on the side as shown in FIG. 4, the inner periphery 28 of top region 20 is positioned against the user's chest, with rounded end 24 positioned just under the user's arm. The inner periphery 28 conforms to the user's chest and stomach, especially when the user is pregnant. In this way, the curved surface in combination with the size of top region 20 supports the user's upper body, and especially the stomach when lying on the user's side. Hence, for pregnant user's, pillow 10 provides relief to the belly, helping to reduce the amount of stress imposed by the weight of the pregnancy. More particularly, the top region 20 may be positioned underneath the belly to provide support to the stomach.

The curved nature of pillow 10 also permits it to curve around the body so that bottom region 22 fits between the user's legs. This provides additional comfort to the user while lying on her side. Further, this arrangement helps to align the user's hips, legs and back to help relieve back pain and other body aches often associated with pregnancies. In combination with a traditional pillow 40 which supports the user's head, pillow 10 helps to support and stabilize the rest of the body, thereby providing over-all comfort while sleeping or resting.

One convenient way to construct pillow 10 is by using one or more pieces of fabric that are joined together to form case 14. An opening may then be left in case 14 to permit fill material 16 to be stuffed or blown into case 14. Examples of how to blow fill materials into case 14 are described generally in copending U.S. patent application Ser. No. 10/769,007, filed Jan. 29, 2004, the complete disclosure of which is herein incorporated by reference. Once pillow body 12 has the appropriate amount of fill material, the opening may be closed such as by sewing it closed. The amount of fill material will preferably provide enough support for the belly while also being compressible enough so that the pillow is comfortable between the user's legs. For example, pillow 10 may be stuffed such that when held between the top and bottom regions, the pillow droops or hangs down. Also, this amount of stuffing permits pillow 10 to be compressed during storage as described hereinafter.

One exemplary way to construct case 14 and cover 18 is by using three pieces of fabric, referred to as face pieces 42 and 44 and sidepiece 46 (for case 14), and face pieces 48 and 50 and side piece 52 (for cover 18). These pieces may be sewn together to form case 14 and cover 18. An opening may be provided between piece 42 and side piece 46 to insert the fill material into case 14 as previously described.

For cover 18, a fastener 54 may be provided between one of the face pieces 48 or 50 and side piece 52. This permits cover 18 to easily be inserted over and removed from case 14 simply by opening fastener 54 to provide an access way into the interior of cover 18. Other techniques for making and other cover configurations that may be used are described in U.S. Pat. Nos. 6,453,493 and 6,625,828, and copending U.S. application Ser. No. 10/638,058, filed Aug. 7, 2003 and Ser. No. 10/789,784, filed Feb. 27, 2004, the complete disclosures of which are herein incorporated by reference. For example, fastener 54 could also be placed on the opposite side of cover 18 (along the inner periphery), along one of the faces, along one of the ends, in the center of side piece 52, and the like. Further, as an alternative to a zipper, fasteners such as snaps, clips, strings, folds, buttons and the like may be used in addition to those described in the incorporated reference materials. In some cases, a fastener may not be needed. Cover 18 may be configured so that it closely approximates the shape and size of pillow body 12.

Constructing pillow body 12 and cover 18 in the manner illustrated provides a number of advantages. One is ease of manufacturing. For example, by using side piece 46, the outer periphery 30 (which is larger than inner periphery) is provide with additional material. This provides a smooth outer surface with no buckling. Also, side piece 46 permits pillow 10 to be folded inward (about inner periphery 28) while making it difficult to fold pillow 10 outward (about outer periphery 30) because of the seam between pieces 48 and 50. This helps pillow 10 to maintain its shape during use so that it will remain nestled against the user's body.

Although shown constructed form three pieces of fabric, it will be appreciated that other numbers may be used, such as two equally sized pieces that are sewn along the periphery of the pillow. Alternatively more than three pieces could be used.

Figure 5:
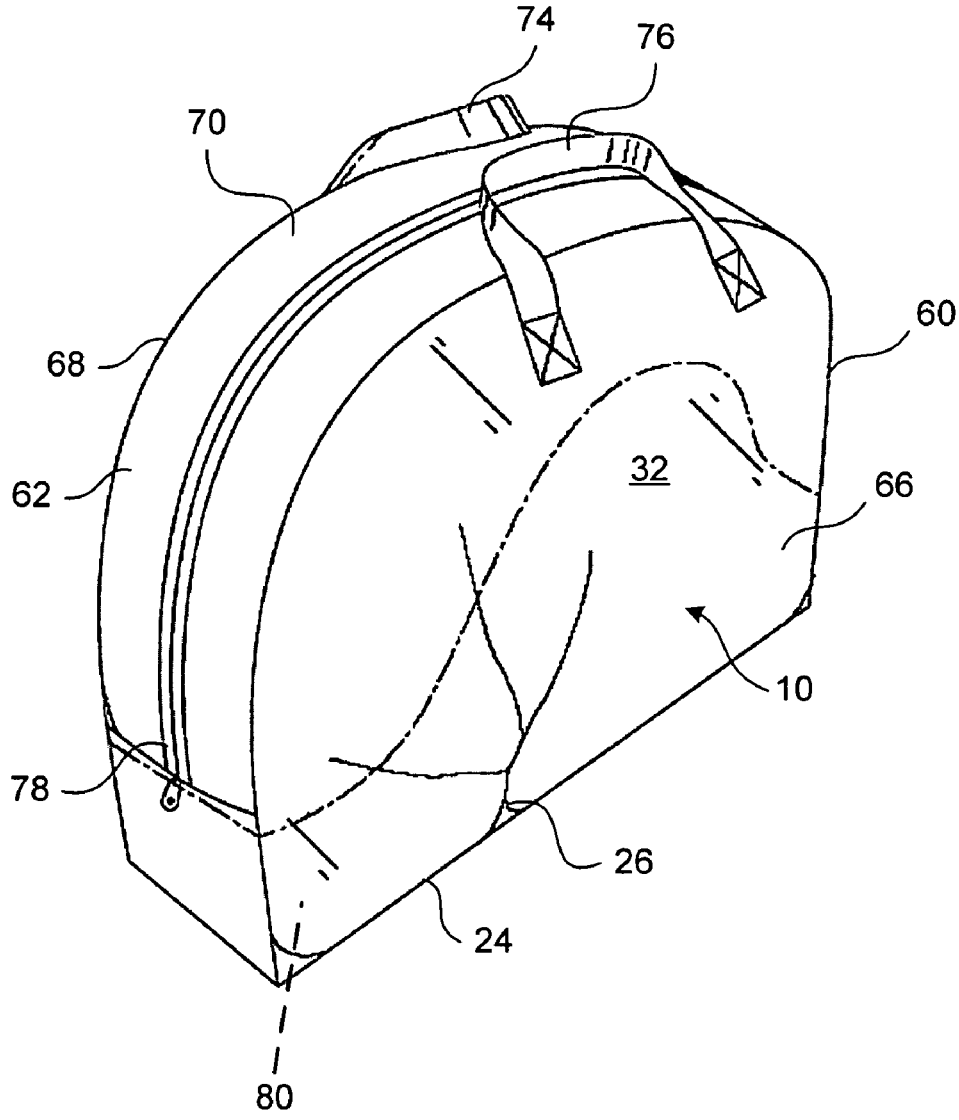
FIG. 5 illustrates the pillow of FIG. 1 held within one embodiment of packaging.

As shown in FIG. 5, pillow 10 may conveniently be stored in packaging 60, such as for display at a point of sale or for storage after purchase. Packaging 60 comprises a case 62 having a bottom end 64, faces 66 and 68 and a top 70. Near top 70, case 62 is curved and a pair of handles 74 and 76 are provided for convenient handling of case 62. Further, an opening with a fastener 78, such as a zipper, is used to provide access into the interior of case 62.

As previously mentioned, pillow 10 may be constructed to be resilient enough to permit it to be stuffed into case 62. Conveniently, case 62 may be constructed of a transparent material to permit pillow 10 to be visualized while in case 62. Optionally, an insert 809 (shown in phantom line) may be placed into case 62 to provide additional support to case 62 and to provide a place for product information, advertising information and the like. Insert 80 may extend up one or both faces 66 and 68 and along bottom 64, as well as up the sides. This helps to hold case 62 upright as shown in FIG. 5 on its own accord. Other examples of packaging that may be used are described generally in U.S. Pat. No. 6,540,977, and copending U.S. patent application Ser. No. 10/460,508, filed Jun. 11, 2003, the complete disclosures of which are herein incorporated by reference.

The invention has now been described detail for purposes of clarity and understanding. However it will be appreciated that certain changes and modifications may be practiced within the scope of the appended claims.

What is claimed is:

1. A pillow comprising:

a curved pillow body having a top region, a top end at the periphery of the top region, a bottom region, and a bottom end at the periphery of the bottom region, wherein the top region and the bottom region generally meet at an apex of curvature of the pillow body, wherein the top region is larger in size than the bottom region, wherein the bottom region is adapted to be placed between a user's legs while the user is lying on the user's side while the top region is adapted to conform to the user's stomach and chest and the top end is adapted to be positioned under the user's arm while the user is lying on the user's side; and wherein the distance between the bottom end and the apex is in the range from about 8 inches to about 16 inches, and the distance between the top end and the apex is in the range from about 20 inches to about 30 inches.

2. A pillow as in claim 1, wherein the pillow body is kidney bean shaped in geometry having an inner periphery and an outer periphery, and wherein the inner periphery is configured to conform to the user's stomach and chest while the bottom region is positioned between the user's legs.

3. A pillow as in claim 1, wherein the top region and the bottom region generally meet at an apex of curvature of the pillow body.

4. A pillow as in claim 3, wherein the distance defined by a line between an end of the top region and an end of the bottom region and a perpendicular line to the apex is in the range from about 2 inches to about 10 inches.

5. A pillow as in claim 3, wherein the distance between an end of the bottom region and the apex is in the range from about 8 inches to about 16 inches.

6. A pillow as in claim 3, wherein the distance between an end of the top region and the apex is in the range from about 20 inches to about 30 inches.

7. A pillow as in claim 3, wherein the pillow body has a width at the bottom region that is in the range from about 6 inches to about 10 inches, a width at the apex that is in the range from about 10 inches to about 18 inches, and a width at the top region that is in the range from about 14 inches to about 20 inches.

8. A pillow as in claim 3, wherein the pillow body has a girth at the bottom region that is in the range from about 20 inches to about 28 inches, a girth at the apex that is in the range from about 30 inches to about 40 inches, and a girth at the top region that is in the range from about 36 inches to about 48 inches.

9. A pillow as in claim 3, wherein the pillow body has a height at the bottom region that is in the range from about 3 inches to about 7 inches, a height at the apex that is in the range from about 6 inches to about 10 inches, and a height at the top region that is in the range from about 6 inches to about 12 inches.

10. A pillow as in claim 1, wherein the pillow body has a length in the range from about 26 inches to about 38 inches.

11. A pillow as in claim 1, wherein the pillow body has curved ends at the top region and the bottom region.

12. A pillow as in claim 1, wherein the pillow body comprises a casing that encloses a fill material.

13. A pillow as in claim 12, wherein the fill material comprises polyester fibers.

14. A pillow as in claim 12, wherein the casing comprises a first piece of fabric, a second piece of fabric, and a third piece of fabric, wherein the third piece of fabric connects the first and second pieces, and wherein the third piece defines the outer periphery while the first and second pieces define first and second faces of the pillow body.

15. A pillow comprising:

a curved pillow body having a top region, a top end at the periphery of the top region, a bottom region, and a bottom end at the periphery of the bottom region, wherein the top region and the bottom region generally meet at an apex of curvature of the pillow body, wherein the top region is larger in size than the bottom region, wherein the bottom region is adapted to be placed between a user's legs while the user is lying on the user's side while the top region is adapted to conform to the user's stomach and chest and the top end is adapted to be positioned under the user's arm while the user is lying on the user's side, wherein the distance between the bottom end and the apex is in the range from about 8 inches to about 16 inches, and the distance between the top end and the apex is in the range from about 20 inches to about 30 inches; and a cover removably positioned over the pillow body.

16. A pillow as in claim 15, wherein the pillow body is kidney bean shaped in geometry having an inner periphery and an outer periphery, and wherein the inner periphery is configured to conform to the user's stomach and chest while the bottom region is positioned between the user's legs.

17. A pillow as in claim 16, wherein the pillow body comprises a casing that encases a fill material, wherein the casing comprises a first piece of fabric, a second piece of fabric, and a third piece of fabric, wherein the third piece of fabric connects the first and second pieces, and wherein the third piece defines the outer periphery while the first and second pieces define first and second faces of the pillow body.

18. A pillow as in claim 15, wherein the cover comprises a first piece of fabric, a second piece of fabric, and a third piece of fabric, wherein the third piece of fabric connects the first and second pieces, and wherein the third piece defines an outer periphery of the cover while the first and second pieces define first and second faces of the cover.

19. A pillow as in claim 15, wherein the cover further defines an opening through which the pillow body is insertable, and further comprising a fastener to close the opening.

20. A method for supporting a user while the user is lying on the user's side, the method comprising:

providing a pillow that comprises a curved pillow body having a top region, a top end at the periphery of the top region, and a bottom region, wherein the top region is larger in size than the bottom region;

placing the bottom region between a user's legs; and positioning the top region against the user's stomach and chest and the top end under the user's arm so as to conform to the shape of the user's stomach and chest.

21. A method as in claim 20, wherein the pillow body is kidney bean shaped in geometry having an inner periphery and an outer periphery, and wherein the inner periphery positioned against the user's stomach and chest while the bottom region is positioned between the user's legs.

22. A method as in claim 20, wherein the user is a pregnant woman, and wherein the top region is positioned so as to support the user's stomach.

23. A method as in claim 20, further comprising inserting a cover over the pillow prior to using the pillow.

24. A pillow comprising:

a curved pillow body having a top region, a top end at the periphery of the top region, a bottom region, a bottom end at the periphery of the bottom region, wherein the top region and the bottom region generally meet at an apex of curvature of the pillow body;

and wherein the top region is larger in size than the bottom region, the bottom region is adapted to be placed between a user's legs while the user is lying on the user's side while the top region is adapted to conform to the user's stomach and chest and the top end is adapted to be positioned under the user's arm while the user is lying on the user's side; and the distance between the bottom end and the apex is in the range from about 8 inches to about 16 inches, and the distance between the top end and the apex is in the range from about 20 inches to about 30 inches.

* * * * *